US006571972B1

(12) United States Patent
Bouc et al.

(10) Patent No.: US 6,571,972 B1
(45) **Date of Patent: *Jun. 3, 2003**

(54) BULK DRUM LID WITH TWO BUNG OPENINGS

(75) Inventors: Gary L. Bouc, Beatrice, NE (US); Dwight Nichols, Beatrice, NE (US); Michael Faltys, Beatrice, NE (US)

(73) Assignee: Hoover Materials Handling Group, Inc., Beatrice, NE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,431

(22) Filed: Oct. 5, 1998

(51) Int. Cl.[7] ..... B65D 51/18

(52) U.S. Cl. ..... 220/254.2; 220/254.8; 220/89.1; 220/89.2; 220/203.08; 137/68.19

(58) Field of Search ..... 220/254, 89.2, 220/265, 89.1, 367.1, 89.4, 601, 361, 363, 203.01, 203.08, 254.1, 254.2, 254.8, 255; 137/68.27, 68.23, 68.19

(56) References Cited

U.S. PATENT DOCUMENTS

| | | | | | |
|---|---|---|---|---|---|
| 2,271,786 | A | * | 2/1942 | Watkins | 220/89.4 X |
| 2,962,185 | A | * | 11/1960 | Starr et al. | 220/254 |
| 3,189,072 | A | * | 6/1965 | Starr | 220/254 |
| D229,892 | S | * | 1/1974 | Dubois et al. | |
| 3,972,450 | A | * | 8/1976 | Walters | 220/601 |
| 4,000,839 | A | * | 1/1977 | Tecco et al. | 220/254 X |
| 4,441,622 | A | * | 4/1984 | Von Holdt | 220/254 |
| 4,449,640 | A | * | 5/1984 | Finkelstein | 220/254 X |
| 4,643,825 | A | * | 2/1987 | Weslowski | 210/188 |
| 4,699,290 | A | * | 10/1987 | Adams | 220/254 X |
| 4,706,698 | A | * | 11/1987 | Short, III | 137/68.1 |
| 4,712,711 | A | * | 12/1987 | Geering et al. | 220/254.2 |
| D295,108 | S | * | 4/1988 | Przytulla | |
| 4,767,021 | A | * | 8/1988 | Pies | 220/601 |
| 4,899,777 | A | * | 2/1990 | Stone et al. | 137/74 |
| 4,941,584 | A | * | 7/1990 | Bowers et al. | 220/601 |
| 5,014,873 | A | * | 5/1991 | Clemens et al. | 220/601 |
| 5,150,814 | A | * | 9/1992 | Broyhill | 220/601 |
| 5,211,289 | A | * | 5/1993 | Matthews | 220/254 |
| 5,213,128 | A | * | 5/1993 | Baierd | 137/73 |
| 5,228,469 | A | * | 7/1993 | Otten et al. | 137/80 |
| 5,413,240 | A | * | 5/1995 | Hunter et al. | 220/254 |
| 5,490,608 | A | * | 2/1996 | Hawkins | 220/601 X |
| 5,544,779 | A | * | 8/1996 | Yamamoto et al. | 220/203.08 X |
| 5,567,053 | A | * | 10/1996 | Ashe | 137/846 |
| 5,582,201 | A | * | 12/1996 | Lee et al. | 137/454.2 |
| 5,593,060 | A | * | 1/1997 | Przytulla | 220/601 X |
| 5,632,505 | A | * | 5/1997 | Saccone et al. | 220/203.08 X |
| 5,718,353 | A | * | 2/1998 | Kanfer et al. | 220/254 X |
| 5,761,261 | A | * | 6/1998 | Karrrh | 137/68.23 X |
| 5,832,673 | A | * | 11/1998 | Cho | 220/254 X |
| 5,941,406 | A | * | 8/1999 | Przytulla | 220/254.2 |

FOREIGN PATENT DOCUMENTS

| | | | | |
|---|---|---|---|---|
| WO | 93/04937 | * | 3/1993 | 220/601 |

* cited by examiner

*Primary Examiner*—Robin Hylton
(74) *Attorney, Agent, or Firm*—Wood, Phillips, Katz, Clark & Mortimer

(57) ABSTRACT

A lid is shown for use with a portable tank or intermediate bulk container, or the like, having a threaded collar defining a port opening. The lid includes a generally circular top wall and a generally cylindrical sidewall connected to the top wall and having an inner threaded surface for threading to the threaded collar to close the port opening, in use. First and second circular openings through the top wall define first and second bung openings. First and second cylindrical collars extend downwardly from the top wall surrounding the respective first and second openings. Each cylindrical collar has a threaded inner wall for receiving a removable closure to selectively close the first and second bung openings.

17 Claims, 6 Drawing Sheets

BULK DRUM LID WITH TWO BUNG OPENINGS

FIELD OF THE INVENTION

This invention relates to a lid for a portable tank or intermediate bulk container, or the like, and more particularly to a lid having two bung openings.

BACKGROUND OF THE INVENTION

A portable tank or intermediate bulk container (IBC) has found widespread use as an alternative to fifty-five gallon drums for transporting and storing liquids. A typical IBC in one form provides 275 gallon capacity. Various structure have been used for IBCs, including blow molded bottles or metal or poly containers. In one form, the IBC includes a six inch filling port surrounded by a threaded collar. A six inch lid is selectively secured to the collar to close the filling port. Bottom discharge from the IBC is provided through a valve.

A typical six inch lid includes a concave circular top wall surrounded by a cylindrical sidewall. In some versions the lid includes a centrally located bung opening for receiving a threaded bung. Alternatively, the bung opening can be closed with a vent. However, the lid does not provide for both a bung and a vent.

It can be difficult to maintain a pressure tight seal at the bung gasket through a wide range of pressures and bung tightening torques. High pressures and/or low bung tightening torques might allow the bung gasket to blow out from the force of the pressure, causing it to fail to seal the pressure.

A flat or concave top surface allows puddling of liquid or collection of solid matter contamination on the top surface of the lid. This puddling or contamination would be subject to entering the bung opening of the lid when the lid was either loosened or removed.

The present invention is directed to overcoming one or more of the problems discussed above in a novel and simple manner.

SUMMARY OF THE INVENTION

In accordance with the invention there is provided a six inch bulk drum lid with two bung openings.

According to another aspect of the invention there is provided a bulk drum lid with an integral fusible vent.

In accordance with a further aspect of the invention there is provided a bulk drum lid with a raised ridge surrounding a bung opening to support a bung gasket.

In accordance with a different aspect of the invention there is provided a bulk drum lid with a convex top wall to prevent puddling and discourage build-up of sold contamination.

Broadly, there is disclosed herein a lid for use with a portable tank or intermediate bulk container, or the like, having a threaded collar defining a port opening. The lid includes a generally circular top wall and a generally cylindrical sidewall connected to the top wall and having an inner threaded surface for threading to the threaded collar to close the port opening, in use. First and second circular openings through the top wall define first and second bung openings. First and second cylindrical collars extend downwardly from the top wall surrounding the respective first and second openings. Each cylindrical collar has a threaded inner wall for receiving a removable closure to selectively close the first and second bung openings.

It is a feature of the invention to provide first and second annular ridges extending upwardly from the top wall circumferentially surrounding the respective first and second openings. Each ridge has an inner diameter slightly larger than a diameter of its respective bung opening.

It is another feature of the invention that the lid is of integral molded plastic construction.

It is a further feature of the invention that the top wall comprises a convex shaped wall.

It is yet another feature of the invention to provide a shoulder extending upwardly from the top wall surrounding each bung opening. The shoulder is a single continuous shoulder surrounding both bung openings. First and second annular ridges extend upwardly from the shoulder circumferentially surrounding the respective first and second openings.

In accordance with an alternative aspect of the invention, the lid comprises a generally circular top wall and a generally cylindrical sidewall connected to the top wall and having an inner threaded surface for threading to a threaded collar to close the port opening in use. First and second circular shoulders are integrally formed with the top wall, at least one of the shoulders defining a wall thickness less than a thickness of the top wall to provide a fusible vent to rupture under high temperature and pressure conditions.

It is a feature of the invention to provide a circular bung opening through one of the shoulders and a cylindrical collar extending downward from the top wall surrounding the bung openings, the cylindrical collar having a threaded inner wall for receiving a closure to selectively close the bung opening.

It is another feature of the invention to provide first and second annular ridges extending upwardly from the respective first and second shoulders. A circular bung opening is provided through one of the shoulders and ridge surrounding the one shoulder has an inner diameter slightly larger than a diameter of the bung opening.

Further features and advantages of the invention will be readily apparent from the specification and from the drawing.

DETAILED DESCRIPTION OF THE INVENTION

Figure 1:
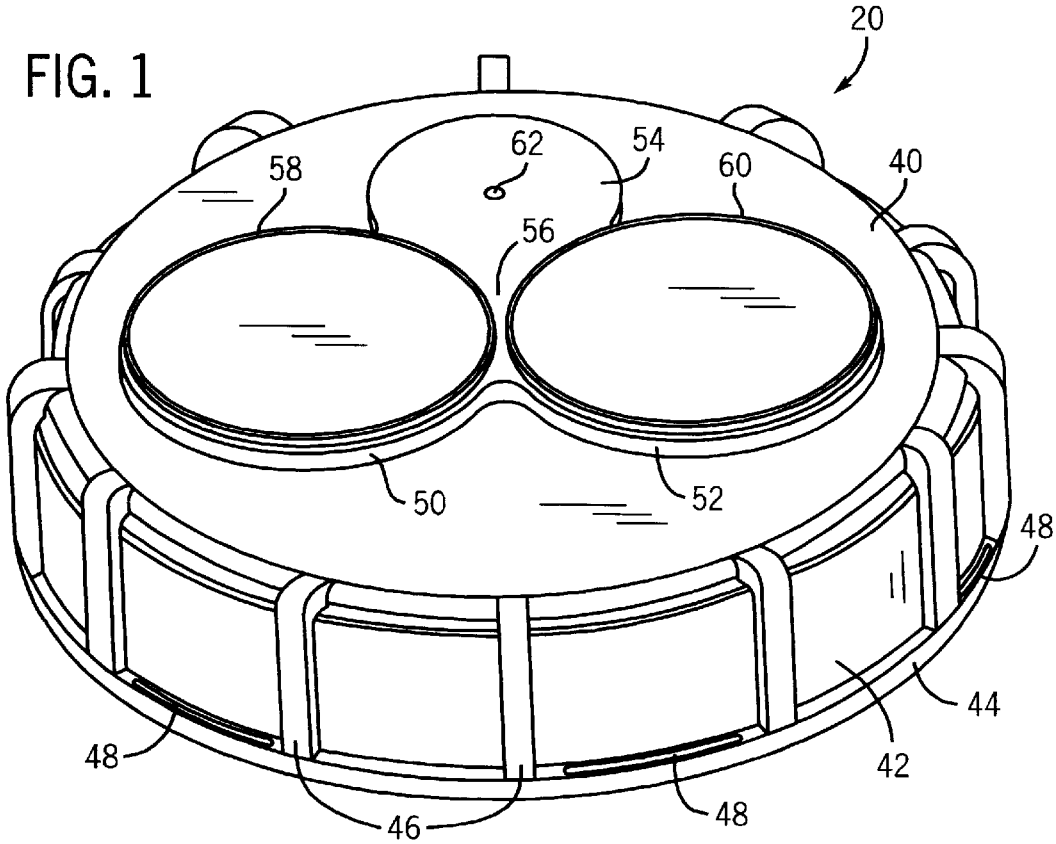
FIG. 1 is a perspective view of a first embodiment of a bulk drum lid according to the invention.
Figure 12:
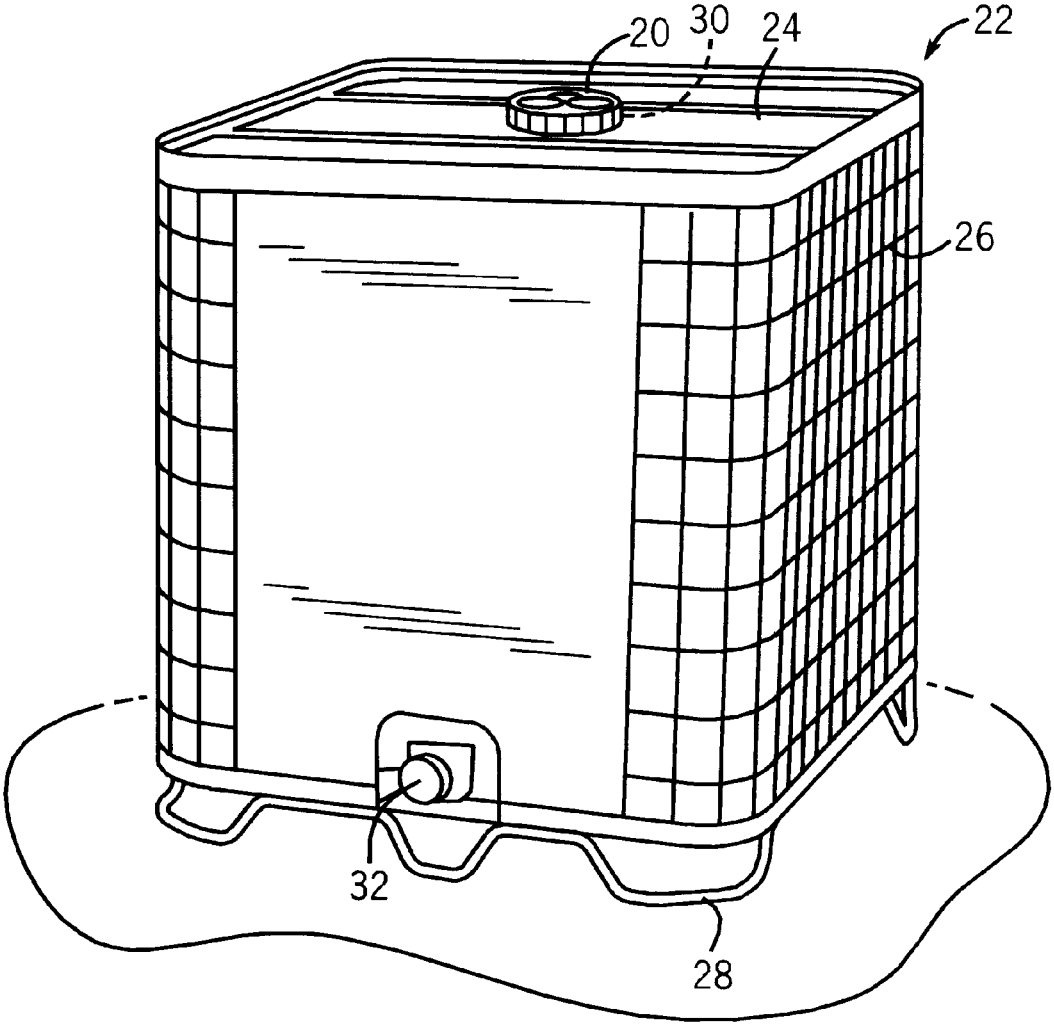
FIG. 12 illustrates an intermediate bulk container utilizing the bulk drum lid according to the invention.

Referring to FIG. 1, a six inch bulk drum lid 20 according to the invention is illustrated. The bulk drum lid 20 is adapted for use with a portable tank or intermediate bulk container, or the like. Referring to FIG. 12, an intermediate bulk container (IBC) in one form is illustrated. The IBC 22 includes a 275-gallon plastic bottle 24 surrounded by a wire cage 26. The cage 26 is supported on tubular legs 28. The plastic bottle 24 includes a threaded collar (not shown) defining a port opening 30 selectively closed by the bulk drum lid 20. The bulk drum lid 20 can be removed to provide access to the port opening to fill the bottle 24 with a liquid or other material. A valve 32 at the bottom of the bottle 24 is used for emptying the bottle 24 in the conventional manner.

While not shown, the port opening 30 is surrounded by a six inch threaded collar, as is conventional in the industry. The plastic bottle 24 comprises a 275-gallon bottle manufactured of HDPE by extrusion blow molding.

The present invention is specifically directed to a lid for use with a portable tank or intermediate bulk container or the like. The IBC 22 shown and discussed herein is for illustration only. The lid 20 can be used with other designs and styles of IBCs, including metal, metal/poly, corrugated/poly, all poly, rim polymer, and collapsible cage or bag-in-bag, using a threaded opening.

Referring again to FIG. 1, the lid 20 comprises a generally circular top wall 40. A generally cylindrical sidewall 42 is connected to the top wall 40. The cylindrical sidewall 42 has an inner threaded surface 44, see FIG. 6, for threading to the threaded collar to close the port opening 30, in use. A flange 44 extends radially outwardly from a bottom edge of the sidewall 42. A plurality of gripper ribs, two of which are referenced with numeral 46, extend radially outwardly from the sidewall 42 circumferentially spaced about the top wall 40. Plural cable slots 48 are provided through the flange 44 in the conventional manner.

The top wall 40, while generally planar, is actually slightly convex shaped, as shown more specifically below relative to FIG. 7. First, second and third circular shoulders 50, 52 and 54 are integrally formed with the top wall 40 in a generally triangular configuration. The shoulders 50, 52 and 54 overlap and are thus joined at a connecting port 56. The shoulders 50, 52 and 54 and connecting portion 56 are at a raised elevation relative to the remainder of the top wall 40. A first annular ridge 58 extends upwardly from the first shoulder 50. A second annular ridge 60 extends upwardly from the second shoulder 52. A conical notch 62 extends downwardly at a center point of the third shoulder 54.

The lid 20 is of integral plastic construction typically made from polyethylene plastic, such as Mobil HMA-045 HDPE or Solvey G50-100 HDPE. The shoulders 50 and 52 are approximately two and one half inch in diameter. Both are off center on the top wall 40, as is the third shoulder 54. As illustrated, the lid 20 is provided with no bung openings. By providing suitable provisions in tooling, the first shoulder 50, the second shoulder 52, or both can be provided with a bung opening. Consequently, in accordance with the invention a lid can be provided which has either one, two or no two-inch bung openings.

Figure 2:
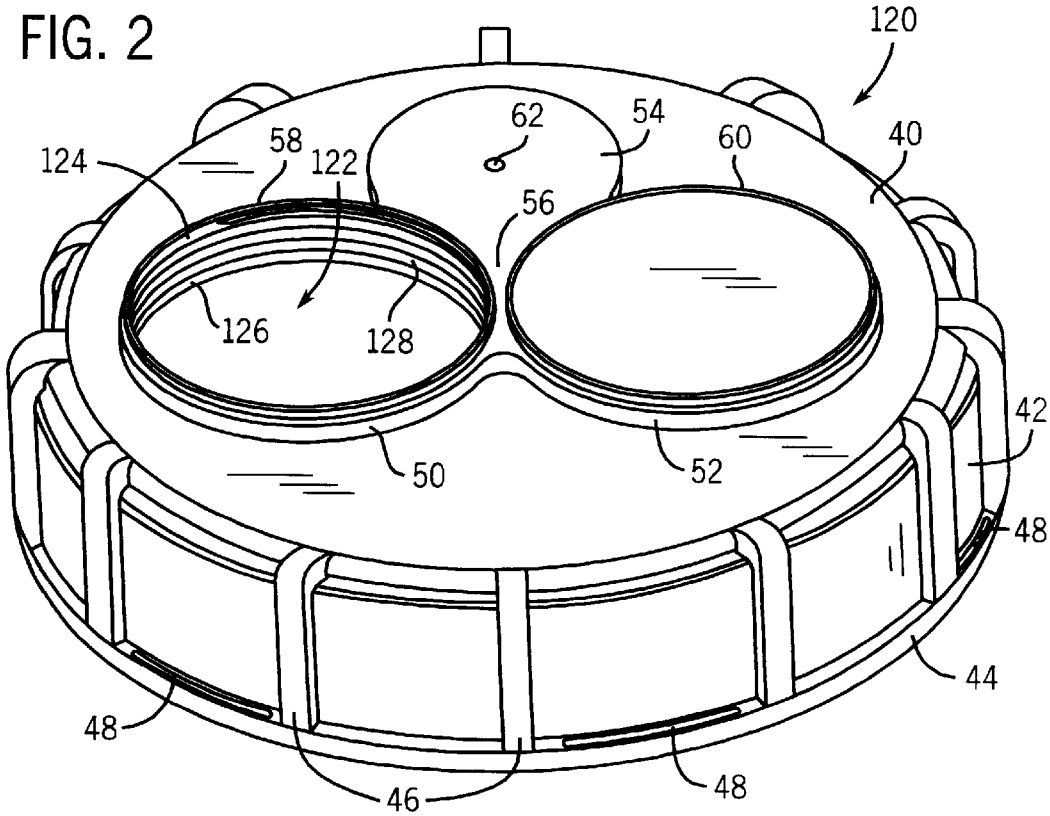
FIG. 2 is a perspective view of a second embodiment of a bulk drum lid according to the invention.

Referring to FIG. 2, a lid 120 according to a second embodiment of the invention is illustrated. The lid 120 is generally similar to the lid 20 of FIG. 1, except for the provision of a single bung opening 122. For convenience, like reference numerals illustrate like components relative to the lid 20 of FIG. 1. The bung opening 122 is provided by a through opening 124 in the first shoulder 50, and thus the top wall 40. A cylindrical collar 126 extends downwardly from the top wall 40 surrounding the through opening 124. The collar 126 has a threaded inner wall 128 for receiving a removable closure, as described below.

Figure 3:
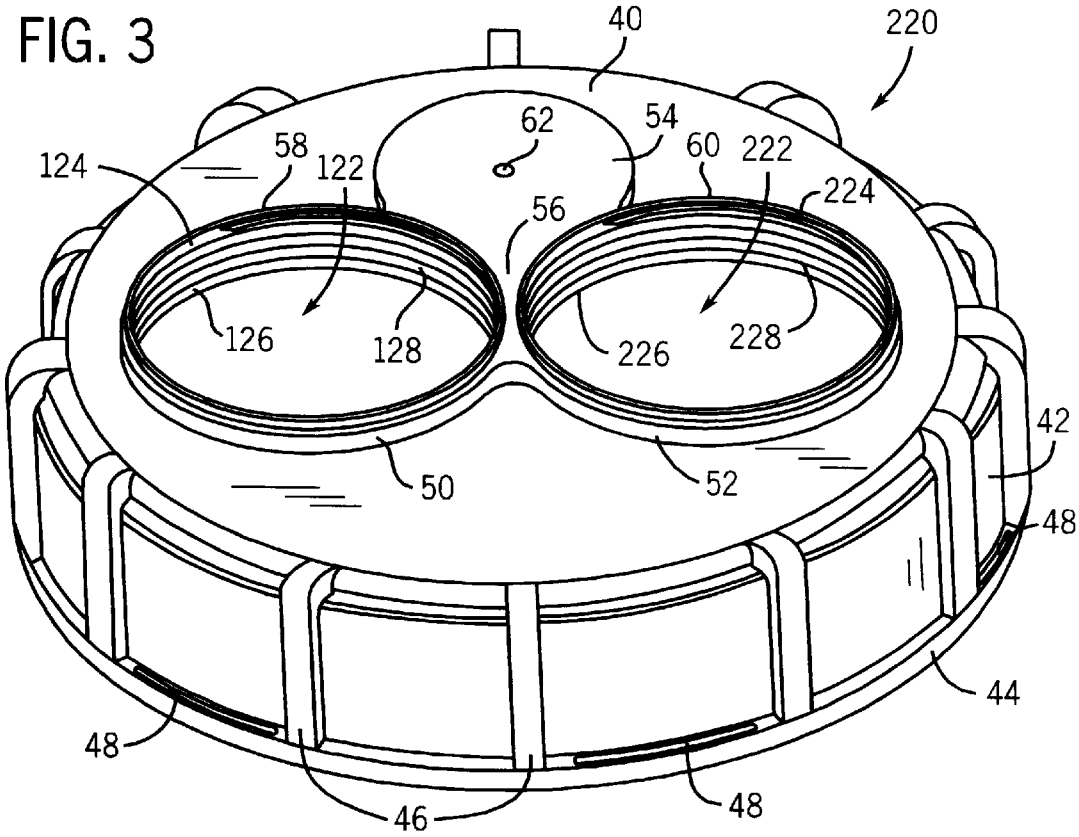
FIG. 3 is a perspective view of a third embodiment of a bulk drum lid according to the invention.
Figure 4:
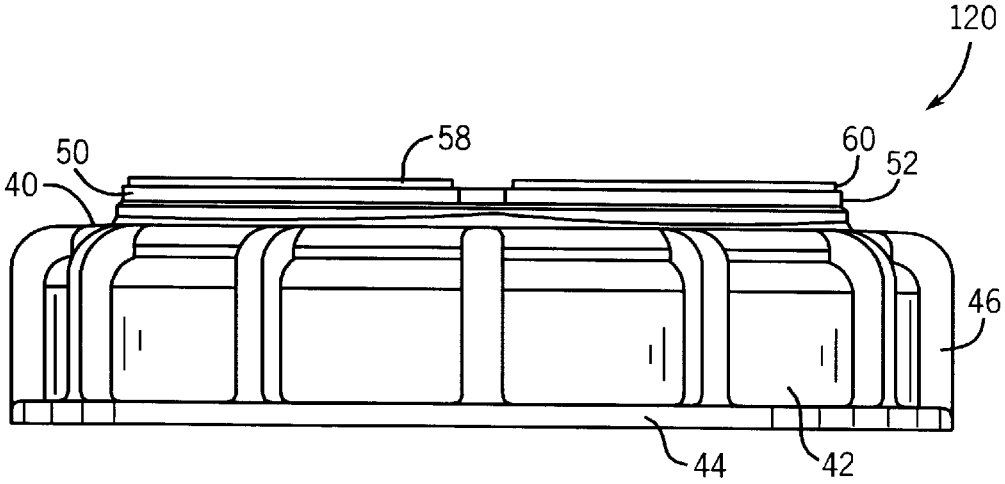
FIG. 4 is a front elevation view of the bulk drum lid according to the invention.

Referring to FIG. 3, a six inch bulk drum lid 220 according to a third embodiment of the invention is illustrated. The lid 220 is generally similar to the lid 120 of FIG. 2, except for the provision of a second bung opening 222. For convenience, like reference numerals illustrate like elements relative to the lid 120 of FIG. 2. A second circular opening 224 is provided through the second shoulder 52, and thus the top wall 40, to define the second bung opening 222. A second cylindrical collar 226 extends downwardly from the top wall 40 surrounding the second opening 224. The cylindrical collar 226 has a threaded inner wall 228 for receiving a removable closure to selectively close the second bung opening 222, as described below. The first and second bung openings 122, 22 each have a diameter. The combined diameters of the first and second bung openings 122, 222 extend over greater than the majority of the diameter of the top wall 40.

Figure 5:
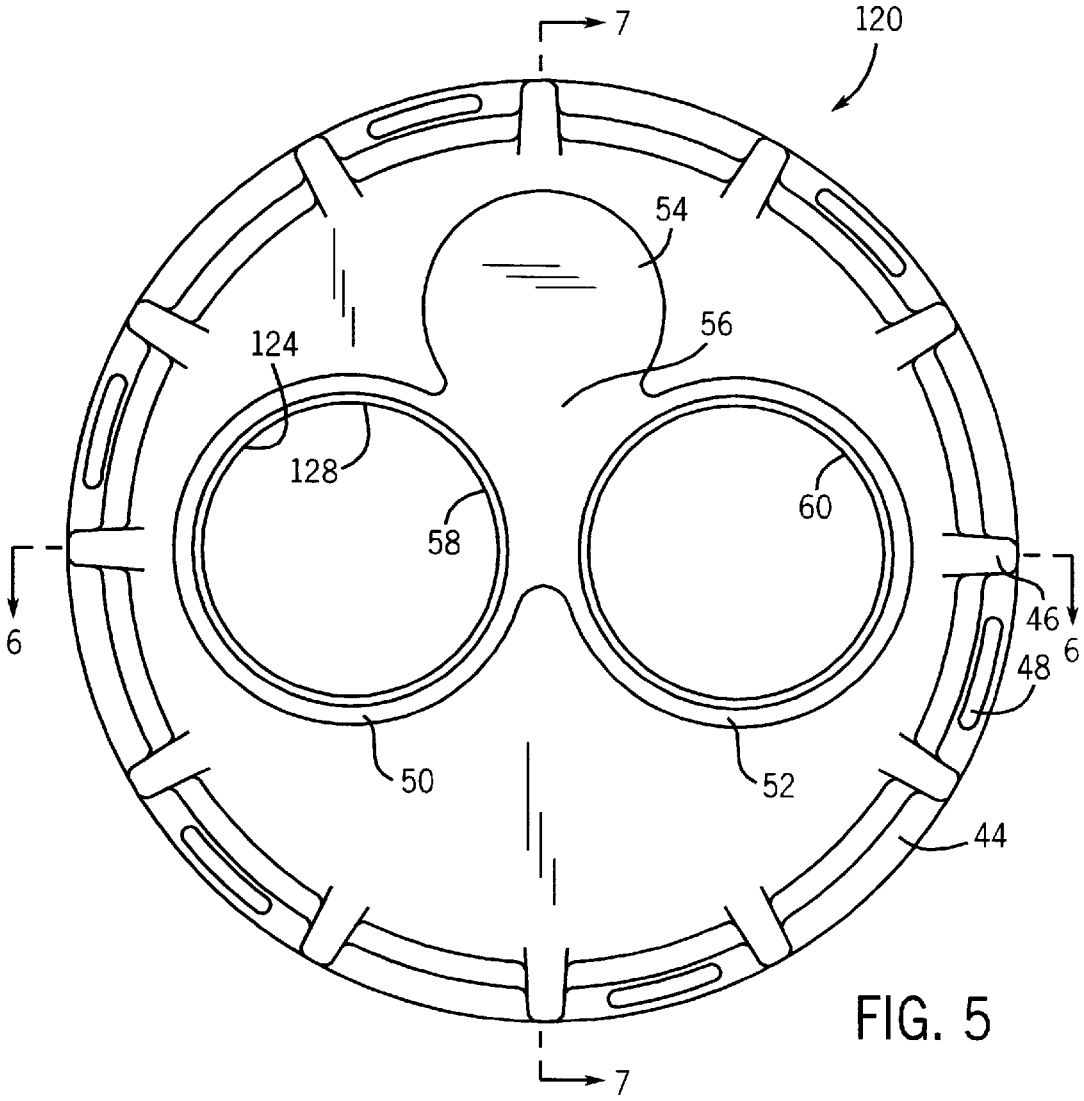
FIG. 5 is a top plan view of the bulk drum lid of FIG. 2.
Figure 6:
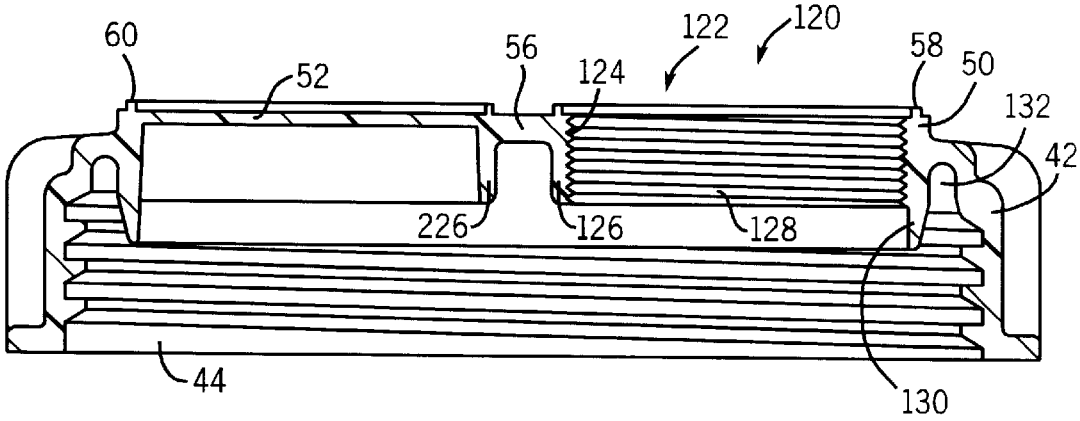
FIG. 6 is a sectional view taken along the line 6—6 of FIG. 5.
Figure 7:
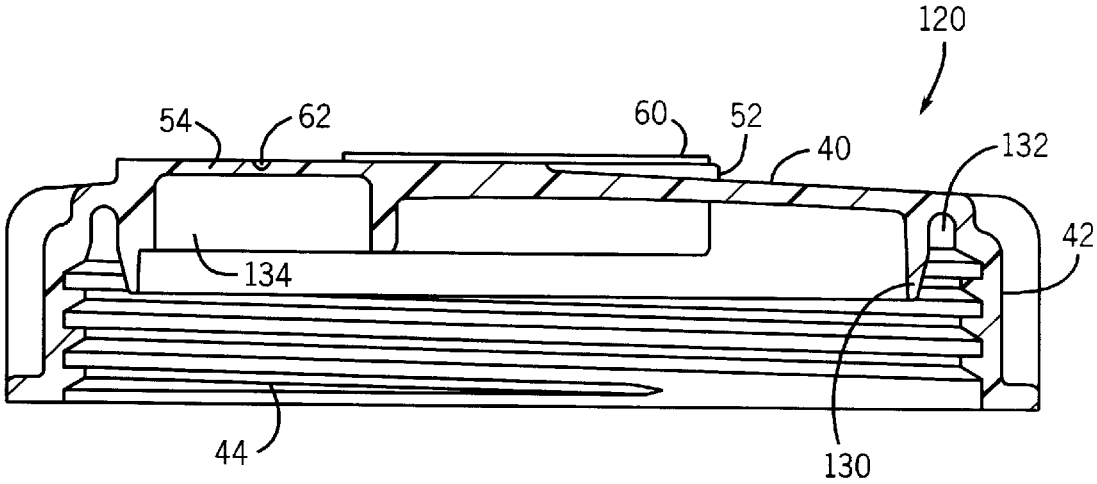
FIG. 7 is a sectional view taken along the line 7—7 of FIG. 5.

Referring to FIGS. 5–7, the lid 120 is illustrated in greater detail. In general, the features of the three lids 20, 120 and 220 are similar except for the number of bung openings provided.

Referring particularly to FIGS. 6 and 7, a cylindrical backup wall 130 extends downwardly from the top wall inwardly from the sidewall 42 to define a channel 132 therebetween. A gasket (not shown) may be placed in the channel 132 for sealing to the port opening, in use. The cylindrical collars 126 and 226 extend downwardly from the top wall 40 in all three embodiments. The particular collar is only threaded, as at 128, if a bung opening is to be provided. The convex shape of the top wall 40 is particularly illustrated in FIG. 7. In the illustrated embodiment of the invention, the top wall 40 is provided with approximately a forty inch radius. The shoulders 50, 52, 54 and connecting portion 56 are generally planar. The third shoulder 54 has a wall thickness similar to the main portion of the top wall 40. The wall thickness of the first and second shoulders 50 and 52 are thinner and in the illustrated embodiment are approximately 0.09 inches or 3/32 inch. As shown in FIG. 7, a third cylindrical collar 134 extends downwardly from the top wall surrounding the third shoulder 54. The notch or dimple 62 is provided as a drill guide so that, if necessary, an opening can be drilled through the third shoulder 54 and suitable threading, if necessary, providing in the third collar 134 to receive a suitable removable closure, as necessary or desired.

By providing a closure with two bung openings, one of the openings can be utilized to permanently accommodate a vent for the tank. Thus, the vent can be left undisturbed while the second bung opening is utilized for filling of the tank.

The lids 20 and 120 include an integral fusible vent. A fusible vent must blow out and release pressure when the combination of pressure and temperature reach specified levels in a tank. This provides a safety feature for the tank if it is exposed to overheating conditions, such as in a fire. The use of the polyethylene plastic and the shoulder wall thickness on the order of 0.09 inch or 3/32 inch are selected so that under high temperature and pressure conditions the material softens under high temperature and the pressure causes either the first or second shoulder 50 or 52 to rupture to vent the tank.

The raised ridges 58 and 60 surrounding the respective bung openings 122 and 222 supports a bung gasket to prevent it from blowing radially outward from the bung.

Figure 8:
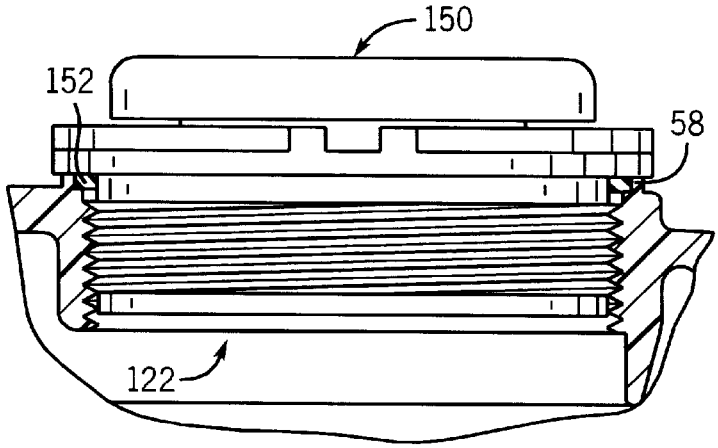
FIGS. 8–11 are partial sectional views illustrating various closures secured to the lid of FIG. 2.
Figure 9:
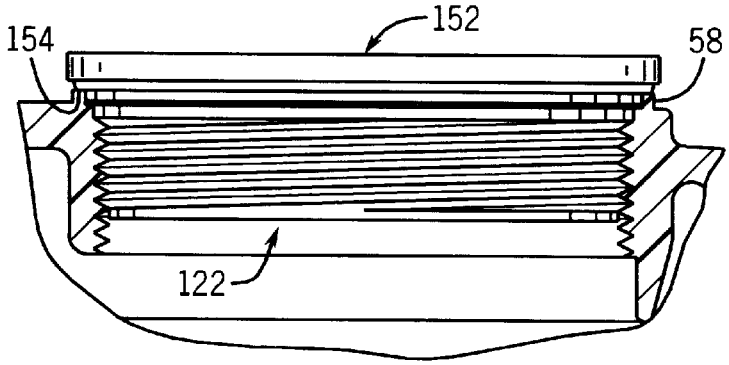
Figure 10:
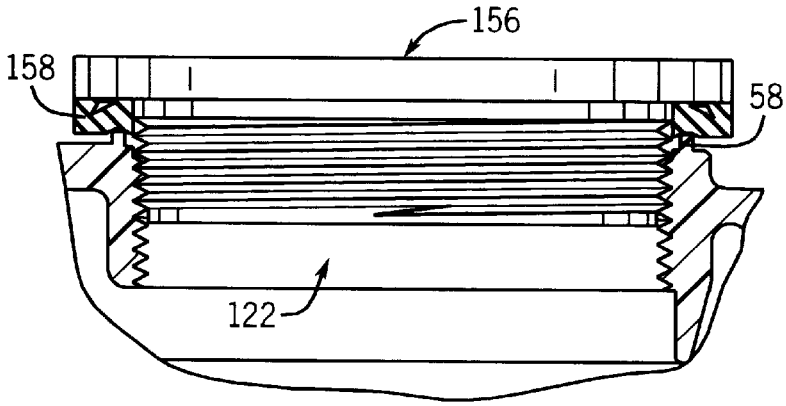
Figure 11:
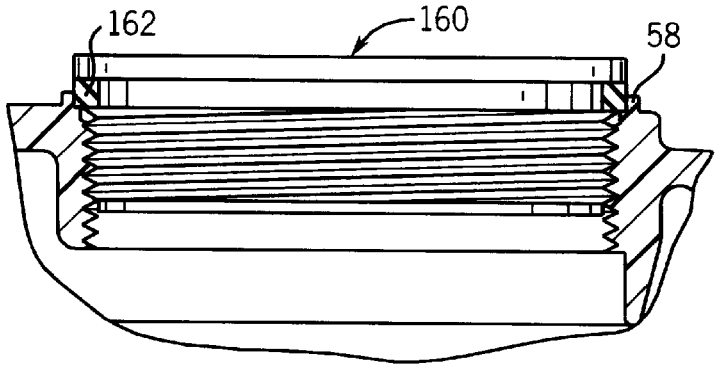

This allows the bung gasket to maintain a pressure tight seal over a much wider range of pressure and a much wider range of bung tightening torques. This feature is particularly illustrated in FIGS. 8–11. FIG. 8 illustrates the bung opening 122 closed with a vent 150 having an O-ring 152. As is apparent, the O-ring 152 is positioned radially inwardly of the ridge 58. FIG. 9 illustrates the opening 122 closed by a bung plug 152 in which the ridge 58 is received in a shoulder 154 of the plug 152. FIG. 10 illustrates a bung 156 having a gasket 158 of flat rectangular cross section approximately 0.100 inch thick by 0.250 inches wide. The raised ridge 58 bites into the flat cross section of the gasket 158 and improves its sealing capability over a wide range of torque. FIG. 11 illustrates a bung 160 having a square cross section gasket 162 that fits snugly inside the ridge 58. Thus, the ridge 58 helps retain the various gaskets from blowing outward from the force of the pressure to improve sealing capabilities over a wider range of pressures.

The ridges 58 and 60 around the bung openings also provide a raised area to serve as a dike to prevent the entry of contamination on the top surface of the lid from entering into the container and its contents when the bung is loosened or removed. This feature aids in the concave or domed feature of the top wall 40, which also protects against the entrance of contamination.

Thus, the invention broadly comprehends an improved six inch bulk drum lid.

We claim:

1. A lid for use with a bulk packaging container having a threaded collar defining a port opening the lid comprising:

a circular top wall;

a cylindrical side wall connected to said top wall and having an inner threaded surface for threading to a threaded collar to close the port opening, in use;

first and second circular openings through the top wall, defining first and second bung openings;

first and second cylindrical collars extending downward from the top wall surrounding the respective first and second openings, each cylindrical collar having a threaded inner wall for receiving a removable closure to selectively close the first and second bung openings; and a shoulder extending upwardly from the top wall surrounding each bung opening wherein the shoulder is a single continuous shoulder surrounding both bung openings.

2. A lid for use with a bulk packaging container having a threaded collar defining a port opening, the lid comprising:

a circular top wall;

a cylindrical side wall connected to said top wall and having an inner threaded surface for threading to a threaded collar to close the port opening, in use; and first and second circular shoulders integrally formed with the top wall, at least one of the shoulders defining a wall thickness less than a thickness of the top wall to provide a fusible vent to rupture under high temperature and pressure conditions.

3. The lid of claim 2 further comprising a circular bung opening through one of the shoulders and a cylindrical collar extending downward from the top wall surrounding the bung opening, the cylindrical collar having a threaded inner wall for receiving a closure to selectively close the bung opening.

4. The lid of claim 2 further comprising first and second annular ridges extending upwardly from the respective first and second shoulders.

5. The lid of claim 4 further comprising a circular bung opening through one of the shoulders and the ridge surrounding the one shoulders has an inner diameter slightly larger than a diameter of the bung opening.

6. The lid of claim 2 wherein the lid is of integral molded plastic construction.

7. The lid of claim 2 wherein the top wall comprises a convex shaped wall.

8. The lid of claim 2 wherein the first and second shoulders are connected to provide a single continuous shoulder.

9. A shipping container comprising:

a bulk packaging container having a threaded collar defining a port opening; and a molded lid for closing the port opening, comprising a circular top wall having a diameter, a cylindrical side wall connected to said top wall and having an inner threaded surface for threading to the threaded collar to close the port opening, first and second circular openings through the top wall, defining first and second bung openings each with a diameter, and first and second cylindrical collars extending vertically from the top wall surrounding the respective first and second openings, each cylindrical collar having a threaded inner wall for receiving a removable closure to selectively close the first and second bung openings, the combined diameters of the first and second bung openings extending over at least a majority of the diameter of the top wall.

10. The shipping container of claim 9 further comprising first and second annular ridges extending upwardly from the top wall circumferentially surrounding the respective first and second openings.

11. The shipping container of claim 10 wherein each ridge has an inner diameter slightly larger than a diameter of its respective bung opening.

12. The shipping container of claim 9 wherein the lid is of integral molded plastic construction.

13. The shipping container of claim 9 wherein the top wall comprises a convex shaped wall.

14. The shipping container of claim 9 further comprising a shoulder extending upwardly from the top wall surrounding each bung opening.

15. The shipping container of claim 14 wherein the shoulder is a single continuous shoulder surrounding both bung openings.

16. The shipping container of claim 14 further comprising first and second annular ridges extending upwardly from the shoulder circumferentially surrounding the respective first and second openings.

17. The shipping container of claim 9 wherein the first and second bung openings comprise two-inch bung openings.

* * * * *